United States Patent [19]

Plantureux

[11] Patent Number: 4,543,698

[45] Date of Patent: Oct. 1, 1985

[54] SETTING FOR A PRECIOUS STONE AND A METHOD OF MOUNTING THE STONE IN THE SETTING

[75] Inventor: Alain Plantureux, Montpellier, France

[73] Assignee: Jean-Louis Chancel, Geneva, Switzerland

[21] Appl. No.: 550,502

[22] Filed: Nov. 9, 1983

Related U.S. Application Data

[63] Continuation of Ser. No. 282,771, Jul. 13, 1981, abandoned.

[30] Foreign Application Priority Data

Jul. 14, 1980 [FR] France ..... 80 75569

[51] Int. Cl.[4] ..... B23P 5/00; B23P 19/02

[52] U.S. Cl. ..... 29/10; 29/525

[58] Field of Search ..... 29/10, 7, 26, 160.6, 29/525

[56] References Cited

U.S. PATENT DOCUMENTS

| | | | |
|---|---|---|---|
| 1,546,358 | 7/1925 | Atwater | 29/525 |
| 1,804,833 | 5/1931 | Johnston | 29/160.6 |
| 1,815,165 | 7/1931 | Scofield | 29/525 |
| 1,926,197 | 9/1933 | Durr | 29/525 |
| 2,195,598 | 4/1940 | Olson | 29/525 |
| 2,318,776 | 4/1943 | Haug | 29/525 |
| 2,671,945 | 3/1954 | Kretzer | 29/10 |
| 3,339,378 | 9/1967 | Chirol | 29/10 |
| 3,349,649 | 10/1967 | Mele | 29/525 |
| 3,751,795 | 8/1973 | Favre | 29/160.6 |
| 4,222,245 | 9/1980 | Vitan | 29/160.6 |
| 4,292,818 | 10/1981 | Vitan | 29/10 |
| 4,326,333 | 4/1982 | Otto | 29/525 |

FOREIGN PATENT DOCUMENTS 807480 6/1936 France .

*Primary Examiner*—Paul A. Bell
*Assistant Examiner*—Paul M. Heyrana, Sr.
*Attorney, Agent, or Firm*—Charles E. Pfund

[57] ABSTRACT

A setting comprising a mounting, a stone and fastening elements, said mounting containing at least two smooth bore holes spaced apart a distance to receive between them the stone and said fastening elements each comprising a head of larger diameter than the holes, each having an underside corresponding substantially in slope to the slope of the table of the stone and a shank of smaller diameter than the hole having at least one radial protrusion of larger diameter than the hole, said fastening elements being forced into the holes to a position such that the undersides of the heads have engagement with the table of the stone and the protrusions are wedged into the sides of the hole and a method of assembling and securing the stones to the mounting.

8 Claims, 1 Drawing Figure

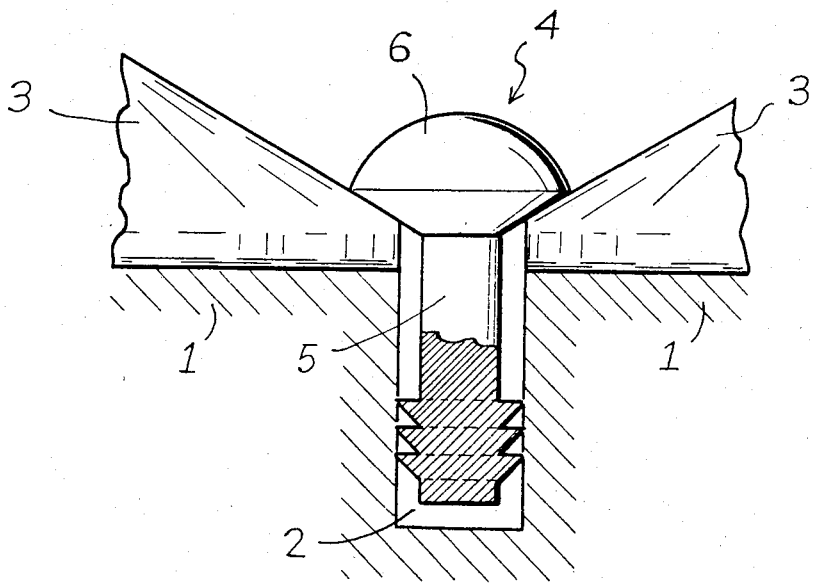
6
4
3
3
1
5
1
2

SETTING FOR A PRECIOUS STONE AND A METHOD OF MOUNTING THE STONE IN THE SETTING

This application is a continuation of application Ser. No. 282,771, filed July 13, 1981, now abandoned.

The present invention relates to a method for setting precious stones in a mounting and it further relates to the products obtained by said method.

It is known in jewelry to set the precious stones on a support mounting by means of claws formed on the said mounting.

A method has also been described in French Pat. No. 1379 772, for setting precious stones in a mounting, which consists essentially in using stirrup pieces placed on the mounting perpendicularly to the alignment of the stones and resting on two adjoining stones of the said alignment. The stirrup pieces are fixed on the mounting by brazing. Said method shows certain limitations when several contiguous rows of stones have to be fixed and it presents certain difficulties for fixing the stirrup pieces on the mounting.

Finally, the system described in French Pat. No. 807 480 is a system for setting stones in jewelry, wherein the yoke of the stone is immobilized in a truncated dish-shaped setting, with concave generatrix, by means of at least two screws which are fixed in lugs framing the said dish-shaped setting and whose heads, with truncated base, rest on the bevel of the table of said stone. This setting system is interesting in theory, but it is relatively difficult to perform in view of the dimensions of the screws (and of the screwpitch) which are used.

The present invention proposes a new industrial method for setting precious stones in a mounting which permits to overcome the difficulties encountered with the stone-setting techniques.

The method according to the invention is characterized in that the setting is achieved by way of individual pieces, constituted by a head and a stem, the said head having a truncated lower part designed so as to rest on the table of the stone or stones to be set in and the said stem being provided with at least one excrescence which, by cooperating with the corresponding hole provided in the mounting, causes enough friction to wedge in each individual piece placed therein.

The individual pieces that can be used according to the invention therefore comprise a stem and a head.

The stem is designed to be introduced in a hole provided in the mounting in such a way that the said piece becomes interlocked with the mounting. The wedging of the said stem (provided with at least one excrescence) inside the hole provided in the mounting will essentially be used to achieve the said interlocking effect. In the special case where a gold mounting is used, with an individual piece also in gold, it was found that with stems having at least one circular excrescence, it is preferable to use a setting with a hardness of 50 to 60 vickers, a rivet of between 130 and 140 vickers, and to arrange for the diameter of the portion of stem which comes into contact with the internal surface of the hole to be about 0.02 mm greater than the diameter of the hole.

It is possible, once the stones have been set by means of said individual pieces to make the said pieces integral with the mounting by spot welding, but this is not absolutely necessary.

What is meant by "excrescence" on the stem of the individual pieces is a metal part projecting from the cylindrical surface forming the stem. Said excrescence can be composed of a plurality of individual elements (or points) or of a flange or preferably a truncated flange with very fine ends (see FIGURE). One or more similar or different excrescences may be be provided on one stem.

The heads of the individual pieces that can be used according to the invention are designed to rest, by their lower face, in one point (or over a small area) on the upper face of the edge of a stone. It suffices therefore that said head has a large enough width (beyond the said stem) for it to rest on said stone or stones. It will be noted that in a special embodiment of the invention the said head can be formed on the spot by deformation of the end of the stem issuing from the hole provided in the mounting. The heads can have very different shapes, circular, ellipsoid, triangular, star-shaped, etc . . . .

In the case where only one stone is to be mounted in a setting, at least two individual pieces according to the invention will be used.

But when several stones are to be mounted, it is advantageous according to the invention to arrange for each piece to rest on at least two contiguous stones. If the stones are disposed in a row, two pieces will preferably be used on either side of the axis of such row, each one of which pieces rests on two adjoining stones. If the stones are arranged in several rows, it will be advantageous, depending on the relative disposition of the stones, to use pieces capable of resting on three or four contiguous stones.

The present invention can be used for setting precious stones in any type of mountings, but it is particularly advantageous in the case of mountings in precious metals or metal alloys.

The preparation of the mounting, before the method according to the invention is applied, is particularly simple; first, holes or cylindrical-shaped cells are made, to receive the stones, and then, holes are drilled to receive the stems of the individual pieces which will be used. It will be especially noted that although the holes or cells designed to receive the stones have to have diameters adapted to the said pieces, the accuracy of machining of said holes is far less important than in the setting of stones by other industrial systems.

By way of example, the one accompanying FIGURE shows one individual piece according to the invention used for setting two contiguous stones on a mounting.

Said FIGURE illustrates:

in 1, the mounting; said mounting is in gold, with a hardness of 55 vickers; one blind hole 2 of 0.43 mm diameter being provided in said mounting, in 3, two stones which appear to be placed on the upper surface of the mounting, but in effect, because of the shape of the previous stones and in particular of diamonds, said stones are placed in holes (not shown) provided in the mounting;

in 4, the individual securing piece composed of a stem 5 and a head 6; the stem has three truncated cone-shaped excrescences giving to the said stem the general shape of a pine tree; said excrescences have diameters of 0.45 mm and the individual piece is in a gold with a hardness of 130 vickers; the head of each individual piece presses, by its lower face, against the bevel of the table of two adjacent stones 3.

What is claimed is:

1. The method of setting precious stones which have an inclined bevel peripherally thereof in a mounting of precious metal of 50 to 60 vickers, comprising forming at least one seat on the mounting for receiving the base of the stone, forming at least two smooth bore holes in the mounting at diametrically-opposite sides of the seat of 0.43 millimeters diameter, the axes of which are perpendicular to the seat, providing two fastening elements of precious metal of 130 to 140 vickers, each comprising a head of larger diameter than the hole and a stem of smaller diameter than the hole, wherein the head has a frustoconical underside and a convex upper side and wherein the inclination of the frustoconical side corresponds to the inclination of the bevel at the periphery of the stone, and wherein the stem is provided adjacent its distal end with an excrescence peripherally thereof of triangular vertical section 0.02 millimeters larger in diameter than the hole, defining a sharp peripheral edge, said excrescence being defined by a flat radial surface at right angles to the axis of the hole, and a flat surface inclined thereto, wherein said flat radial surface precedes the flat inclined surface in the direction of the distal end of the stem, and forcing said fastening elements into the holes at the diametrically-opposed sides of the stone to a position such that the undersides of the heads of the fastening elements have clamping engagement with the bevel peripherally of the stone and the excrescences are wedged into the holes and frictionally engaged with the sides thereof.

2. A method according to claim 1 comprising employing gold metal for the mounting and gold metal for the fastening elements, the gold metal of the mounting being 55 vickers and the gold metal of the fastening 130 vickers.

3. The method according to claim 1 wherein there are a plurality of excrescences adjacent the distal end of the stems.

4. A method according to claim 1 wherein the mounting has two or more seats, wherein there are at least two smooth bore holes diametrically opposite each seat, and wherein the stones in adjacent seats are secured by common fastening elements.

5. A setting comprising a mounting, a stone having a crown and peripherally thereof an inclined table and fastening elements, said mounting defining a seat for receiving a stone and containing at least two smooth bore holes of 0.43 millimeters diameter, the axes of which are perpendicular to the seat spaced apart a distance corresponding to the diameter of the stone and said fastening elements each comprising a head of larger cross section than the hole and a stem of smaller cross section than the hole, said head having a frustoconical underside, the inclination of which corresponds to the inclination of the table of the stone for engagement therewith and said stem having adjacent its distal end an excrescence peripherally thereof of triangular vertical section defining a peripheral edge of 0.02 millimeters greater in diameter than the diameter of the holes formed by a flat surface at right angles to the axis of the stem and a flat surface inclined thereto from said edge toward the distal end of the stem, said fastening elements being forced into the holes to positions such that the undersides of the heads have engagement with the table peripherally of the stone and the excrescence is frictionally edged into the sides of the holes.

6. A setting according to claim 5 wherein there are a plurality of excrescences adjacent the distal end of the stem.

7. A setting according to claim 5 wherein there are two or more seats arranged to receive stones, at least two smooth bore holes arranged diametrically of each seat and at least two fastening elements for each stone and wherein the stones on adjacent seats are secured by a common fastening element.

8. A setting according to claim 5 wherein there are two or more excrescences.

* * * * *